US011543777B2

(12) United States Patent
Matteazzi

(10) Patent No.: US 11,543,777 B2
(45) Date of Patent: Jan. 3, 2023

(54) LARGE DATE CALENDAR DISPLAY MECHANISM AND TIMEPIECE COMPRISING SAME

(71) Applicant: Montres Breguet S.A., L'Abbaye (CH)

(72) Inventor: Daniel Matteazzi, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 609 days.

(21) Appl. No.: 16/658,236

(22) Filed: Oct. 21, 2019

(65) Prior Publication Data

US 2020/0183331 A1 Jun. 11, 2020

(30) Foreign Application Priority Data

Dec. 10, 2018 (EP) ..... 18211352

(51) Int. Cl.
*G04B 19/253* (2006.01)

(52) U.S. Cl.
CPC ..... *G04B 19/2536* (2013.01)

(58) Field of Classification Search
CPC ..... G04B 19/24; G04B 19/25353; G04B 19/2536
See application file for complete search history.

(56) References Cited

U.S. PATENT DOCUMENTS

2008/0279049 A1 11/2008 Schmiedchen et al.
2012/0213037 A1* 8/2012 Schmidt ..... G04B 19/2536 368/37

(Continued)

FOREIGN PATENT DOCUMENTS

CN 1648794 A 8/2005
CN 101326469 A 12/2008

(Continued)

OTHER PUBLICATIONS

Combined Chinese Office Action and Search Report dated Jan. 7, 2021 in Patent Application No. 201911249157.7 (with English translation and English translation of Category of Cited Documents), 10 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A date calendar display mechanism driven via a kinematic chain by a horological movement of a timepiece. A first and second date indicators, the first date indicator remaining still during a 24-hour period separating the passage from the last day of a month having 31 days to the end of the first day of the following month, the kinematic chain including a wheel continuously engaged with the horological movement and having a toothing via which the wheel meshes with a pinion which contributes to driving the first indicator, the wheel being, at one point, devoid of teeth such that, during the above 24-hour period, the wheel does not mesh with the pinion and remains still. A dual jumper pivots about an axis with a first beak via which it is engaged with a toothing of the first date indicator and, at a second beak via which it is engaged with a toothing of the pinion, the dual jumper being elastically held engaged with the first date indicator and with the pinion.

3 Claims, 6 Drawing Sheets

(56) References Cited

U.S. PATENT DOCUMENTS

| | | | | |
|---|---|---|---|---|
| 2016/0187853 | A1* | 6/2016 | Rombach | G04B 19/253<br>368/37 |
| 2018/0173164 | A1* | 6/2018 | Robin | G04B 19/2532 |
| 2019/0332059 | A1* | 10/2019 | Gerber | G04B 19/082 |
| 2019/0384226 | A1* | 12/2019 | Zaugg | G04B 13/008 |

FOREIGN PATENT DOCUMENTS

| | | | |
|---|---|---|---|
| CN | 102692863 | A | 9/2012 |
| CN | 102914959 | A | 2/2013 |
| DE | 196 49 590 | A1 | 10/1997 |
| EP | 1 220 057 | A1 | 7/2002 |
| WO | WO 2007/065889 | A2 | 6/2007 |

OTHER PUBLICATIONS

European Search Report dated Jul. 8, 2019 in European Application 18211352.2 filed on Dec. 10, 2018 (with English Translation of Categories of Cited Documents).

* cited by examiner

LARGE DATE CALENDAR DISPLAY MECHANISM AND TIMEPIECE COMPRISING SAME

CROSS-REFERENCE TO RELATED APPLICATION

This application claims priority to European Patent Application No. 18211352.2 filed on Dec. 10, 2018, the entire disclosure of which is hereby incorporated herein by reference.

TECHNICAL FIELD OF THE INVENTION

The present invention relates to a positioning system for a large date calendar display mechanism. The present invention further relates to a timepiece comprising such a positioning system.

BACKGROUND ART

The present invention relates to so-called "large date" calendar display mechanisms intended to equip mechanical or electromechanical timepieces. These large date calendar display mechanisms are so called because they allow the date indication to be displayed on a larger scale, which eases reading of the date and constitutes an undeniable advantage in terms of the aesthetics of the timepiece equipped with such a mechanism.

A conventional date display mechanism essentially comprises a date ring on the circumference of which the date indications from "1" to "31" are placed. This date ring advances by one step per day. At the end of the months having less than 31 days, the owner of the watch must advance the date ring from the date indication "28" or from the date indication "29" in the event of a leap year, to the date indication "1" when in February, and from the date indication "30" to the date indication "1" for the other months of the year having less than 31 days.

Date display mechanisms requiring intervention by the owner at the end of each month having less than 31 days are referred to as simple date display mechanisms. Date display mechanisms that only require one intervention by the owner per year, when passing from the month of February to the month of March, are referred to as semi-perpetual date display mechanisms. Finally, date display mechanisms that spontaneously pass from the date indication of the last day of a month having less than 31 days to the date indication of the first day of the following month, including on leap years, are referred to as perpetual date display mechanisms.

Date display mechanisms comprising a single ring around the circumference of which the date indications from "1" to "31" are distributed have the advantage of comprising a limited number of parts. They are therefore more cost-effective and easier to incorporate into a horological movement of a mechanical or electromechanical watch. However, only an angular sector of a little less than 12° is available for reproducing each of the 31 date indications on the date ring. The size of the date indications is thus inevitably limited by the dimensions of the date ring, which can make these date indications hard to read.

Large date calendar display mechanisms conventionally comprise a first date indicator on which the indications of the units component of the date from "0" to "9" are placed. These 10 digits are reproduced on the first date indicator according to sequences which depend on the operating mode of the large date display mechanism considered. These date display mechanisms are complemented by a second date indicator on which the indications of the tens component of the date from "0" to "3" are reproduced. Thus, by suitably adjusting the position of the first date indicator relative to the second date indicator, all of the date indications from "01" to "31" can be constituted by combining the indications of the units component of the date borne by the first date indicator with the indications of the tens component of the date borne by the second date indicator. Since the first date indicator only bears the indications of the units component of the date and since the second date indicator only bears the indications of the tens component of the date, additional space is available for reproducing these indications which can thus be larger in size. The reading of a large date calendar indicator device is thus made easier and the aesthetics of a timepiece equipped with such a date indicator device are significantly improved.

However, a problem arises when passing from "31" of a given month to "01" of the following month. More specifically, the indication of the units component "1" of the date with which the date indication "31" is formed is the same as the indication of the units component "1" of the date with which the date indication "01" is formed. As a result, during the passage from the date indication "31" to the date indication "01", the indication of the units component "1" of the date remains unchanged, whereas the indication of the tens component of the date passes from the value "3" to the value "0". In other words, when passing from the end of a month having 31 days to the first day of the following month, the first date indicator on which the indications of the units component of the date are placed, must remain still. In order to reach this objective, the horological movement which, under normal circumstances, allows the large date display mechanism to advance daily, must be prevented from driving the first date indicator when passing from the last day of a month having 31 days to the first day of the following month.

The solution often proposed to overcome this problem consists of depriving one of the wheels located in the kinematic chain between the output of the horological movement and the date indicator bearing the indications of the units component of the date of at least one tooth such that, although driven by the horological movement, this wheel does not, in turn, drive the pinion with which it is engaged when passing from "31" to "01". Given that the pinion remains still during this period, the kinematic linkage between the horological movement and the first date indicator bearing the indications of the units component of the date is interrupted, and the indication of the units component "1" of the date remains unchanged.

However, this solution creates a problem, namely that during the 24 hours that separate the passage from the last day of a month having 31 days to the end of the first day of the following month and during which the pinion is no longer engaged with the wheel which the rest of the time ensures the driving thereof, the maintenance of the position of the pinion, and thus of the first date indicator bearing the indications of the units component of the date, is no longer ensured, which is not acceptable since no guarantee can be given regarding the suitable positioning of the indication of the units component of the date in an aperture made in a dial of the timepiece and through which the date indication can be seen.

SUMMARY OF THE INVENTION

The purpose of the present invention is to overcome the aforementioned problem by procuring a large date calendar display mechanism in which the indexing of a pinion situated in the kinematic chain that drives a unit indicator ring is ensured, even when this pinion is not engaged with a drive wheel with which it meshes under normal circumstances in order to guarantee that the unit indicator ring will remain still during the passage from "31" of a month to "01" of the following month.

For this purpose, the present invention relates to a large date calendar display mechanism driven via a kinematic chain by a horological movement of a timepiece equipped with this large date calendar display mechanism, this large date calendar display mechanism comprising a first date indicator on which the indications of the units component of the date from "0" to "9" are placed, and a second date indicator on which the indications of the tens component of the date from "0" to "3" are placed, whereby all of the date indications from "01" to "31" can be obtained by combining the indications of the units component "0" to "9" of the date, borne by the first date indicator, with the indications of the tens component "0" to "3" of the date, borne by the second date indicator, the first date indicator remaining still during a 24-hour period separating the passage from the last day of a month having 31 days to the end of the first day of the following month, the kinematic chain comprising a wheel that is continuously engaged with the horological movement and which has a perimeter provided with teeth via which the wheel meshes with a pinion which itself contributes to driving the first indicator of the units component of the date, the wheel being, at one point along the perimeter thereof, devoid of teeth such that, during the 24-hour period separating the passage from the last day of a month having 31 days to the end of the first day of the following month, the wheel does not mesh with the pinion which, similarly to the first date indicator, thus remains still, the large date calendar display mechanism further comprising a dual jumper mounted such that it pivots about an axis and which comprises a first beak via which it is engaged with a toothing of the first date indicator and a second beak via which it is engaged with a toothing of the pinion, the dual jumper being elastically held engaged with the first date indicator and with the pinion.

According to one particular embodiment of the invention, the dual jumper comprises a first end at which the first beak is provided, and a second end at which the second beak is provided.

The invention further relates to a timepiece comprising a large date calendar display mechanism of the aforementioned type.

Thanks to these features, the present invention provides a large date calendar display mechanism wherein the positioning of a pinion that contributes to driving the indicator of the units component of the date is constantly guaranteed, even when this pinion is released from any engagement with a wheel via which it is driven by the horological movement of the timepiece equipped with this large date calendar display mechanism.

More specifically, during the passage from a month having 31 days to the first day of the following month, the pinion must be uncoupled from the horological movement so that the indicator of the units component of the date remains still during this period. Effectively, the marking "1" borne by the indicator of the units component of the date is used both to compose the date indication "31" at the end of a month having 31 days, and to compose the date indication "01" at the start of the following month. It is therefore key that the indicator of the units component of the date remains still during this lapse of time so that the date indication that appears through an aperture made in a dial of the timepiece is accurate. As a result, the pinion must be uncoupled so that the horological movement, which operates in a continuous fashion, cannot drive the indicator of the units component of the date.

However, it is easily understood that the fact that the pinion is momentarily uncoupled from the wheel that drives it under normal circumstances creates a problem insofar as the positioning of this pinion cannot be ensured during this period. As a result, when the wheel revolves and is found in a position wherein it is capable of meshing again with the pinion, this pinion may not be appropriately positioned and the wheel may not be able to re-engage with this pinion, which results in the mechanism becoming blocked. It is therefore essential that the correct indexing of the pinion is constantly guaranteed, in particular during the period wherein this pinion is not engaged with the wheel that usually drives it.

Similarly, the dual jumper is engaged with a toothing of the indicator of the units component of the date so as to continuously guarantee the correct positioning of the indication of the units component of the date in the aperture made in the dial of the timepiece.

It should be noted that, since the dual jumper is hinged such that it pivots, it is released from its engagement with the pinion when pushed back by the toothing of the first date indicator, and vice-versa.

BRIEF DESCRIPTION OF THE FIGURES

Other features and advantages of the present invention will be better understood upon reading the following detailed description of one example embodiment of the large date calendar display mechanism according to the invention, said example being provided for the purposes of illustration only and not intended to limit the scope of the invention, given with reference to the accompanying drawing, wherein.

DETAILED DESCRIPTION OF ONE EMBODIMENT OF THE INVENTION

The present invention proceeds from the general inventive idea consisting, in a large date calendar display mechanism, of simultaneously ensuring, by means of a sole dual jumper, the correct positioning of a pinion and of an indicator of the units component of the date driven by this pinion, in particular during the lapse of time where, in order to prevent the indicator of the units component of the date from pivoting, the pinion is no longer engaged with the wheel which, under normal circumstances, transmits to this pinion the energy supplied by the horological movement of the timepiece equipped with the large date calendar display mechanism according to the present invention.

Figure 1:
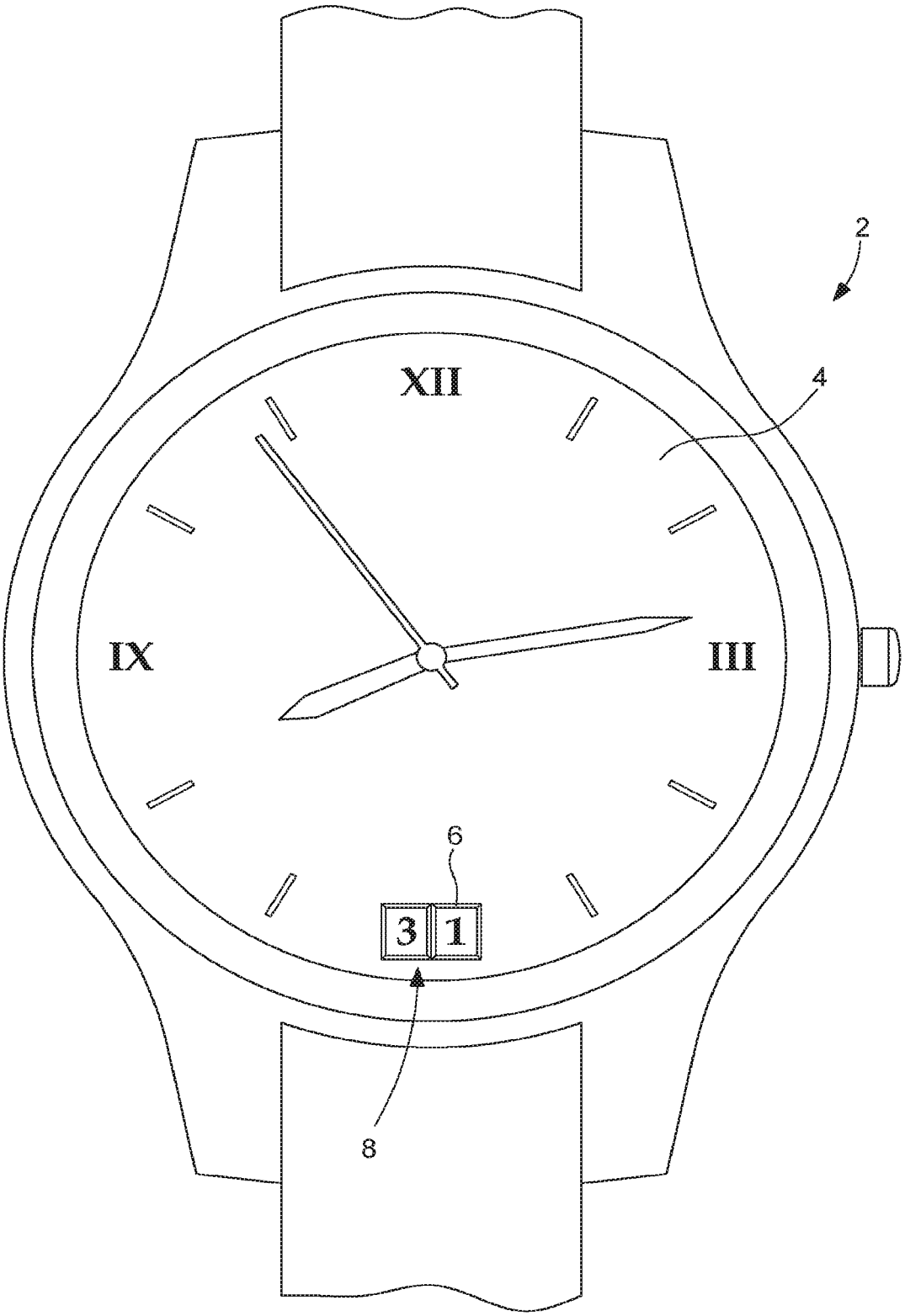
FIG. 1 is an overhead view of a timepiece of the wristwatch type equipped with a large date calendar display mechanism according to the invention.

Denoted as a whole by the general reference numeral 1 and as shown in FIG. 1 accompanying the present patent application, the large date display mechanism equips a timepiece 2 such as a wristwatch which comprises a dial 4 in which an aperture 6 is made, through which a large date indication 8 can be seen.

Figure 2:
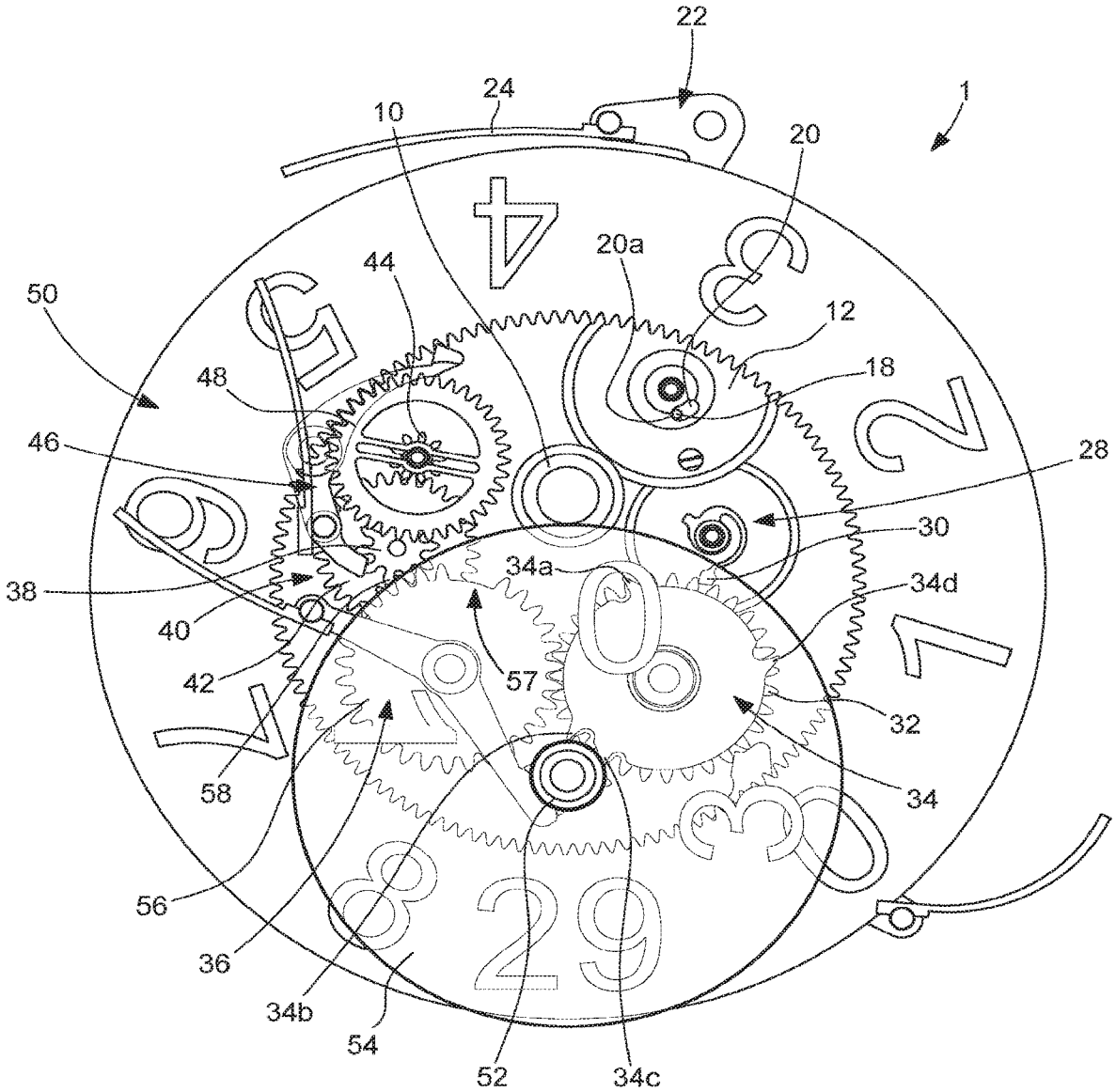
FIG. 2 is a plan view of the large date calendar display mechanism according to the invention, wherein the indicator of the tens component of the date is shown transparently.

With reference to FIG. 2, the large date display mechanism 1 is shown to comprise an intermediate centre wheel 10 which is conventionally rigidly connected to an hour wheel driven by a motion-work of a horological movement (not shown). This intermediate centre wheel 10 meshes with a cam drive wheel 12 which is driven one revolution per day. This cam drive wheel 12 drives, in turn, a cam wheel 14 on which a cam 16 is fixed.

Figure 5:
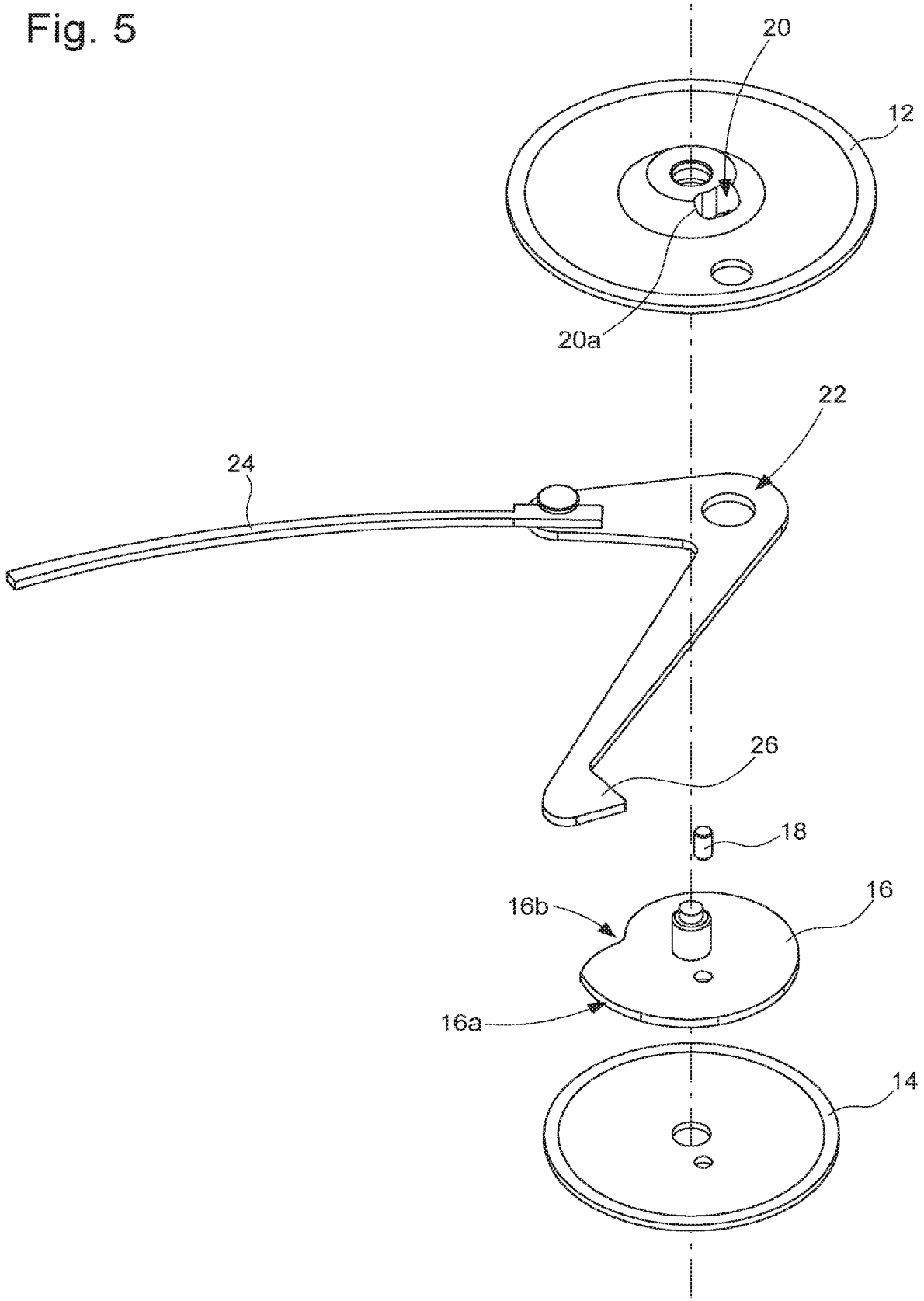
FIG. 5 is a perspective view from below of the large date calendar display mechanism revealing the cam drive mechanism which controls the release of the date display mechanism once per day.

The cam drive wheel 12 and the cam wheel 14 are kinematically connected to one another by means of a pin 18 driven into the cam wheel 14 and which freely passes through an oblong hole 20 made in the cam drive wheel 12 (see FIG. 5). When the cam drive wheel 12 revolves, it drives the cam wheel 14 thanks to the pin 18 which abuts against an inner edge 20*a* of the oblong hole 20. The cam 16 has a profile 16*a* at one point whereof a recess 16*b* is provided. A release lever 22, elastically stressed by a spring 24, comprises a beak 26 via which it follows the profile 16*a* of the cam 16.

Once a day, at around midnight, the release lever 22 falls along the recess 16*b* of the profile 16*a* of the cam 16 and causes the cam wheel 14 to instantly pivot by an angle that is defined by the recess 16*b* of the profile 16*a* of the cam 16. It should be noted that the dimensions of the oblong hole 20 are sufficient to allow the cam wheel 14 to perform the instant pivoting movement thereof without being hindered by the pin 18.

Figure 3:
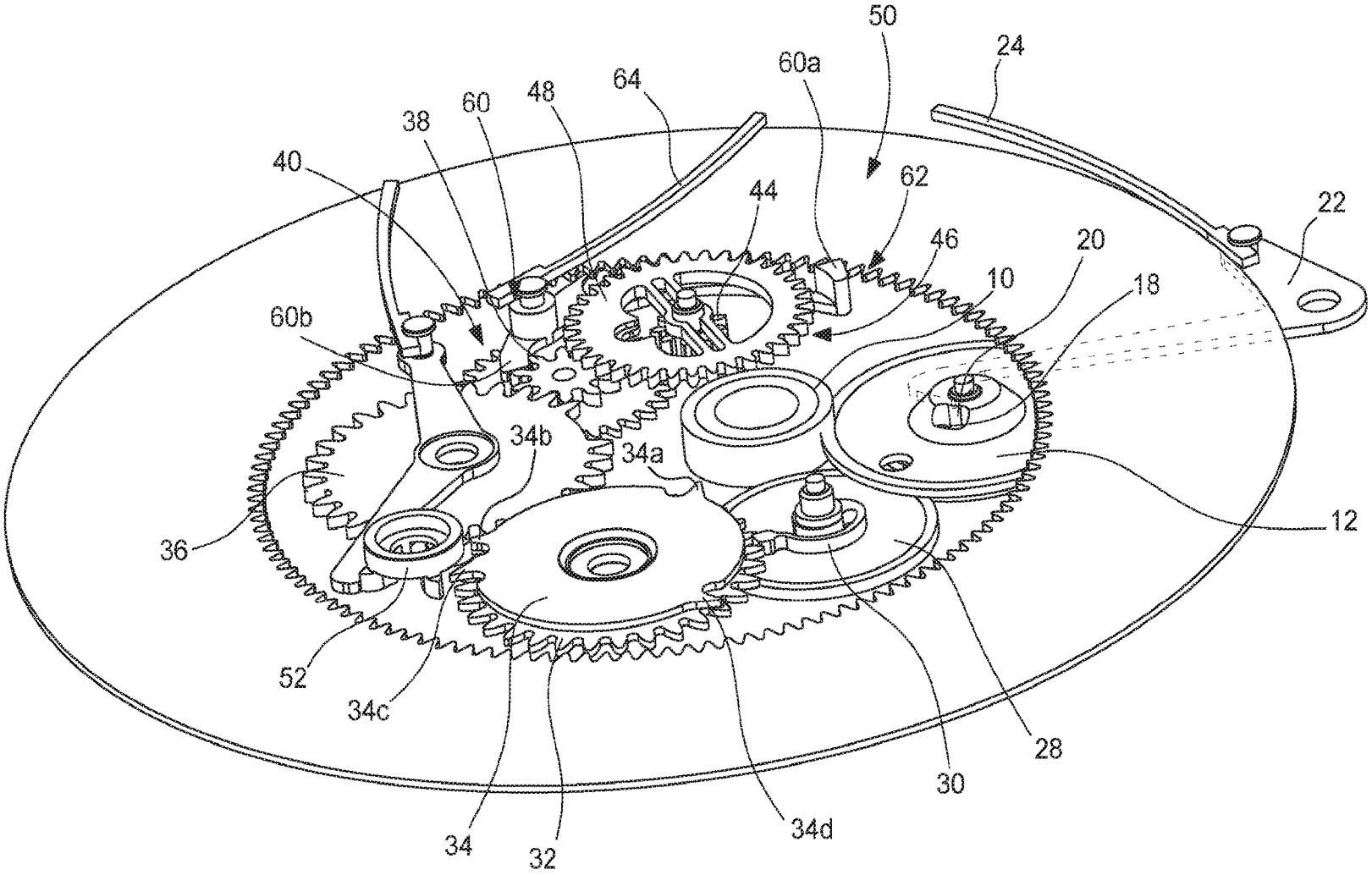
FIG. 3 is a perspective view of the large date calendar display mechanism according to the invention, wherein the kinematic chain driving the indicator of the tens component of the date is more particularly visible.

The cam wheel 14 drives a date drive wheel 28 which bears a finger 30 via which the date drive wheel 28 controls, once a day, the advancing of a thirty-one-teeth wheel 32 by one step (see FIG. 3). Moreover, a programming wheel 34 is fixed to the thirty-one-teeth wheel 32. The thirty-one-teeth wheel 32 meshes, in turn, with a drive wheel 36 itself engaged with an intermediate pinion 38 of an intermediate wheel set 40. Finally, an intermediate wheel 42 of the intermediate wheel set 40 meshes with a units drive pinion 44 of a units drive wheel set 46, a units drive wheel 48 whereof drives an indicator of the units component of the date. For the purposes of illustration only and not intended to limit the invention, this indicator of the units component of the date takes on the form of a ring 50. This units indicator ring 50 bears the indications "0", "1", "2", "3", "4", "5", "6", "7", "8" and "9" which correspond to the indications of the units component of the date and advances by one step a day, except when passing from "31" of a month to "1" of the following month.

The programming wheel 34 is provided with four teeth 34*a*, 34*b*, 34*c* and 34*d* via which this programming wheel 34 drives, by one step every 10 days, a four-teeth star 52 to which an indicator of the tens component of the date is fixed. For the purposes of illustration only and not intended to limit the invention, this indicator of the tens component of the date is designed in the form of a disc 54. The tens indicator disc 54 bears the indications "0", "1", "2" and "3" which correspond to the indications of the tens component of the date.

As specified hereinabove, the units indicator ring 50 advances by one step a day, except when passing from "31" of a month to "1" of the following month. During this passage, the units indicator ring 50 must remain still. More specifically, the marking "1" borne by the indicator of the units component of the date is used both to compose the date indication "31" at the end of a month having 31 days, and to compose the date indication "01" at the start of the following month. It is therefore key that the units indicator ring 50 remains still during this lapse of time so that the date indication that appears through the aperture 6 made in the dial 4 of the timepiece 2 is accurate.

Figure 4:
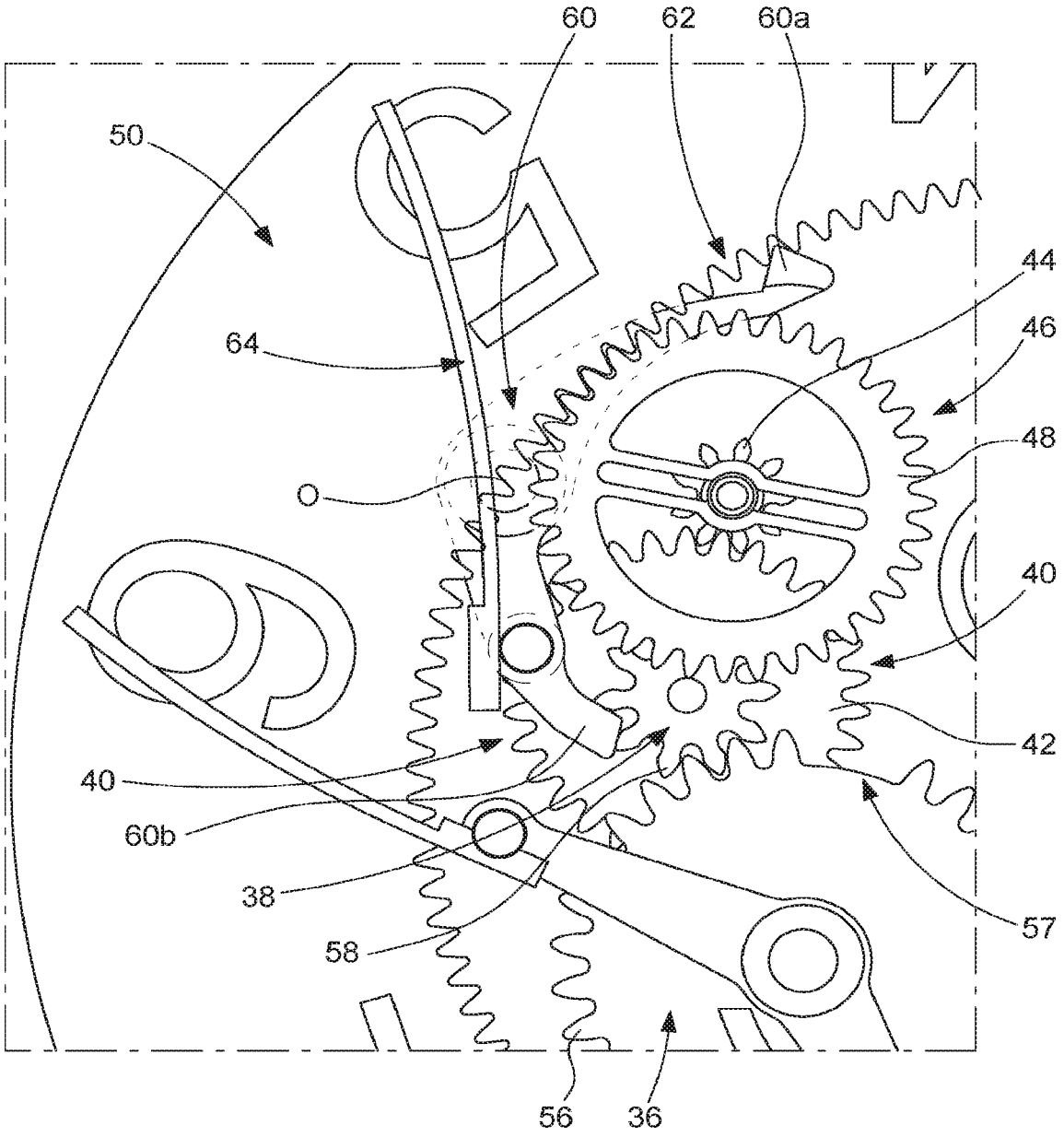
FIG. 4 is a view identical to that of FIG. 2, with the exception that the indicator of the tens component of the date has been omitted.

To reach this goal, two teeth of a thirty-one-teeth toothing 56 of the drive wheel 36 are missing and leave an empty space 57 (see FIG. 4). Thus, when this portion devoid of tooth of the thirty-one-teeth toothing 56 of the drive wheel 36 is facing a toothing 58 of the intermediate pinion 38, the angular position of this intermediate pinion 38 is no longer appropriately ensured which, at the end of the kinematic chain, no longer guarantees the correct positioning of the indication "1" borne by the units indicator ring 50 in the aperture 6 made in the dial 4 of the timepiece 2. Of course, this problem is unacceptable.

This is why, in accordance with the invention, it is proposed to equip the large date display mechanism with a dual jumper 60 arranged such that it pivots about a centre O. This dual jumper 60 is provided with a first beak 60*a* via which it is engaged with the toothing 58 of the intermediate pinion 38, and a second beak 60*b* via which it is engaged with an inner toothing 62 of the units indicator ring 50. The dual jumper 60 is held such that it elastically bears against the toothing 58 of the intermediate pinion 38 and against the inner toothing 62 of the units indicator ring 50 by a spring 64. When the intermediate pinion 38 advances by one step, the dual jumper 60 pivots about the pivot centre O thereof and the beak 60*a* thereof moves aside by passing from the gap between two consecutive teeth of the toothing 58 of this intermediate pinion 38 to the following gap. Simultaneously, the second beak 60*b* of the dual jumper 60 is released from the gap between the two teeth of the inner toothing 62 of the units indicator ring 50 and falls into the following gap. The geometrical configuration of the dual jumper 60 and the positioning of the pivot centre O thereof are such that when the dual jumper 60 pivots, it is simultaneously released from the toothing 58 of the intermediate pinion 38 and from the inner toothing 62 of the units indicator ring 50. Thus, when passing, at the end of a month, from the date indication "31" to the date indication "1" of the following month, the intermediate pinion 38, although not engaged with the drive wheel 36, is held in position by the beak 60*a* of the dual jumper 60 such that there is no risk of the date indication "1" from not being appropriately centred inside the aperture 6 made in the dial 4 of the timepiece 2.

Figure 6:
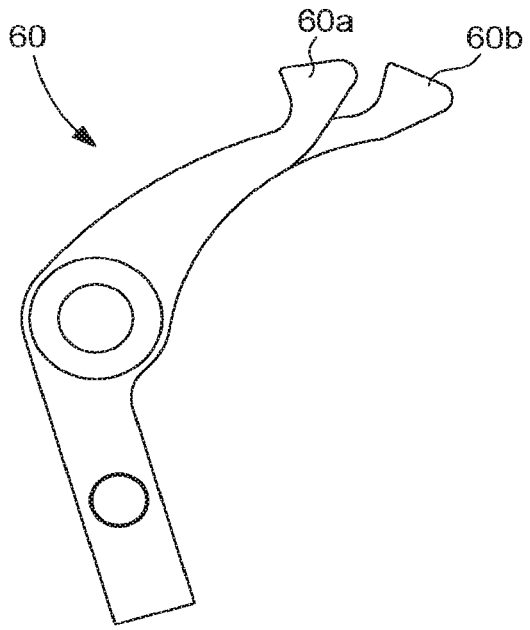
FIG. 6 is a diagrammatic view of another particular embodiment of the invention.

As shown in the drawing, the first beak 60*a* is provided at a first end of the dual jumper 60, whereas the second beak 60*b* is provided at a second end of the dual jumper 60. It is nonetheless understood that, depending on the restrictions for the manufacture of the display mechanism, two beaks 60*a*, 60*b* could be provided such that they extend from the same end of the dual jumper 60 along two different radii (see FIG. 6).

The intermediate pinion 38 forms a part of the intermediate wheel set 40 with an intermediate wheel 42 with which it is coupled in rotation. This intermediate wheel 42 meshes, in turn, with a units drive pinion 44 of a drive wheel set 46 of the units indicator ring 50. This drive pinion 44 is coupled in rotation with the units drive wheel 48 which drives the units indicator ring 50 by meshing with the inner toothing 62 of this units indicator ring 50.

It is evident that the present invention is not limited to the embodiment described above and that various simple alternatives and modifications can be considered by a person skilled in the art without leaving the scope of the invention as defined by the accompanying claims. It should in particular be noted that the number of teeth of the toothing 56 of the drive wheel 36 can differ from thirty-one teeth and that the number of teeth omitted can differ from two, and can be equal to one or three for example. It should also be noted that, depending on the restrictions for the manufacture of the large date display mechanism, the two beaks of the dual jumper can be arranged on the same end of the jumper and extend from this end along two different radii.

NOMENCLATURE

1. Large date display mechanism
2. Wristwatch
4. Dial
6. Aperture
8. Large date indication
10. Intermediate centre wheel
12. Cam drive wheel
14. Cam wheel
16. Cam
16*a*. Cam profile
16*b*. Recess
18. Pin
20. Oblong hole
20*a*. Inner edge
22. Release lever
24. Spring
26. Beak
28. Date drive wheel
30. Finger
32. Thirty-one-teeth wheel
34. Programming wheel
34*a*, 34*b*, 34*c*, 34*d*. Teeth
36. Drive wheel
38. Intermediate pinion
40. Intermediate wheel set
42. Intermediate wheel
44. Units drive pinion
46. Units drive wheel set
48. Units drive wheel
50. Units indicator ring
52. Four-teeth star
54. Tens indicator disc
56. Toothing
57. Empty space
58. Toothing
60. Dual jumper
O. Pivot centre
60*a*. First beak
60*b*. Second beak
62. Inner toothing
64. Spring

The invention claimed is:

1. A date calendar display mechanism driven via a kinematic chain by a horological movement of a timepiece equipped with said date calendar display mechanism, said date calendar display mechanism comprising a first date indicator on which the indications of the units component of the date from "0" to "9" are placed, and a second date indicator on which the indications of the tens component of the date from "0" to "3" are placed, whereby all of the date indications from "01" to "31" can be obtained by combining the indications of the units component "0" to "9" of the date, borne by the first date indicator, with the indications of the tens component "0" to "3" of the date, borne by the second date indicator, the first date indicator remaining still during a 24-hour period separating the passage from the last day of a month having 31 days to the end of the first day of the following month, the kinematic chain comprising a wheel that is continuously engaged with the horological movement and which has a perimeter provided with a toothing via which the wheel meshes with a pinion which itself contributes to driving the first indicator of the units component of the date, the wheel being, at one point along the perimeter thereof, devoid of tooth such that, during the 24-hour period separating the passage from the last day of a month having 31 days to the end of the first day of the following month, the wheel does not mesh with the pinion which, similarly to the first date indicator, thus remains still, the date calendar display mechanism further comprising a dual jumper mounted such that the dual jumper pivots about an axis and which comprises a first beak via which the dual jumper is engaged with a toothing of the first date indicator and a second beak via which the dual jumper is engaged with a toothing of the pinion, the dual jumper being elastically held engaged with the first date indicator and with the pinion.

2. The date display mechanism according to claim 1, wherein the dual jumper comprises a first end at which the first beak is provided, and a second end at which the second beak is provided.

3. A timepiece comprising a date calendar display mechanism according to claim 1.

* * * * *